US006948631B2

(12) United States Patent
Lafond et al.

(10) Patent No.: US 6,948,631 B2
(45) Date of Patent: Sep. 27, 2005

(54) CONTROLLABLE TAMPER PROOF CLOSURE FOR A VIAL

(75) Inventors: Andre Lafond, Mont-St-Hilaire (CA); Yanick Bertin, Vercheres (CA)

(73) Assignee: 3088081 Canada Inc., (CA)

( * ) Notice: Subject to any disclaimer, the term of this patent is extended or adjusted under 35 U.S.C. 154(b) by 65 days.

(21) Appl. No.: 10/754,007

(22) Filed: Jan. 8, 2004

(65) Prior Publication Data

US 2005/0150858 A1 Jul. 14, 2005

(51) Int. Cl.[7] ..... B65D 55/02
(52) U.S. Cl. ..... 215/209; 215/252
(58) Field of Search ..... 215/209, 258, 215/252, 253, 901, 228

(56) References Cited

U.S. PATENT DOCUMENTS

| | | | | |
|---|---|---|---|---|
| 3,994,409 A | * | 11/1976 | Nightengale, Jr. | 215/256 |
| 4,144,983 A | * | 3/1979 | Pauls et al. | 215/216 |
| 4,211,333 A | | 7/1980 | Villarejos | |
| 4,306,357 A | | 12/1981 | Villarejos | |
| 4,566,601 A | * | 1/1986 | Kuenzig | 215/45 |
| 4,567,992 A | * | 2/1986 | Davis | 215/222 |
| 4,871,077 A | | 10/1989 | Ogden et al. | |
| 5,133,470 A | | 7/1992 | Abrams et al. | |
| 5,267,661 A | * | 12/1993 | Luch et al. | 215/256 |
| 5,664,694 A | * | 9/1997 | Bietzer et al. | 215/256 |
| 5,992,660 A | | 11/1999 | Miura et al. | |

FOREIGN PATENT DOCUMENTS

| | | |
|---|---|---|
| EP | 0 509 039 B1 | 10/1992 |
| EP | 0 805 113 A1 | 11/1997 |
| EP | 0 899 204 A1 | 3/1999 |
| WO | WO 97/26941 A1 | 7/1997 |
| WO | WO 01/44102 A2 | 6/2001 |

* cited by examiner

*Primary Examiner*—Lien M. Ngo
(74) *Attorney, Agent, or Firm*—Akerman Senterfitt

(57) ABSTRACT

The present invention provides a tamper proof closure for a vial, which may be used only when needed, by insertion of a security member having engaging means in contact with corresponding engaging means on a ring part of a closure cap so that the cap may t be removed from the vial only with this ring part of the closure cap being separated from the cap by an action exerted by the engaging means of the security member on the engaging means of the ring part.

5 Claims, 3 Drawing Sheets

CONTROLLABLE TAMPER PROOF CLOSURE FOR A VIAL

FIELD OF THE INVENTION

The present invention relates to a closure for a vial. More specifically, the present invention is concerned with a controllable tamper proof closure for a vial.

BACKGROUND OF THE INVENTION

Vial containers with improved closure are known. Tamper resistant containers for storing and transporting liquids and solids for example, such as urine specimens, and tablets are also available.

A widely used method for protecting container vial against tampering and adulteration of the content thereof consists of securing a plastic or a metal seal over the mouth of the container beneath the screw cap.

Another method, such as disclosed in U.S. Pat. No. 4,871,077, consists of forming a barb or hook inside an open upper end of the vial, providing a cap adapted for insertion into the vial having a mating hook formed about a lower edge thereof, and providing sealing rings formed on the outer surface thereof, thereby yielding a tamper-resistant, leak-proof sealing between the enclosure and the vial.

U.S. Pat. Nos. 4,586,622 and 4,449,640 describe an open-top vial covered by a cap having a depending peripheral skirt, in such a way that an inner surface of the cap skirt and an outer surface of the cap are provided with complementary mating interlock elements. Moreover, the cap comprises an integral tear member, defined by at least one weakened, partially circumferential weakened junction lines, such that pulling away the tear member along the junction line allows both annual removal of the cap and ready visual confirmation that vial integrity has been breached.

U.S. Pat. Nos. 4,211,333 and 4,306,357 disclose a vial having a flange about its opening so that, below the flange and spaced apart therefrom, a shoulder defines an indented neck therebetween. An overcap extends over the flange and about the neck to form a skirt about the neck. The skirt has at least a portion thereof extending inwardly in gripping reaction with the neck and limited in removal by contact with the underside of the flange, whereby the cap cannot be removed without destroying a structural integrity thereof.

Although vial containers with improved closure have been proposed, they may usually be used only once.

Therefore, there is a need in the art for a tamper proof closure for a vial, which may be used only when needed.

SUMMARY OF THE INVENTION

More specifically, in accordance with the present invention, there is provided a tamper-proof vial and cap assembly comprising a vial having an upper portion; a cap comprising a main part and a ring part connected to the main part by a weakening line, the cap being able to be secured on the upper portion of the vial, the ring part displaying first engaging means; and a security member insertable between the vial and the cap and displaying second engaging means complementary to the first engaging means of the ring part of the cap; wherein, when the second engaging means of the security member are engaged with the first engaging means of the ring part, the cap may be removed from the vial with the ring part thereof being separated from the main part thereof along the weakening line; and wherein, when the second engaging means of the security member are disengaged from the first engaging means of the ring part, the cap may be removed from the vial with the ring part thereof remaining connected to the main part thereof.

Other objects, advantages and features of the present invention will become more apparent upon reading of the following non-restrictive description of embodiments thereof, given by way of example only with reference to the accompanying drawings.

DESCRIPTION OF EMBODIMENTS OF THE INVENTION

Generally stated, there is provided a tamper proof closure for a vial, which may be used only when needed.

Figure 1:
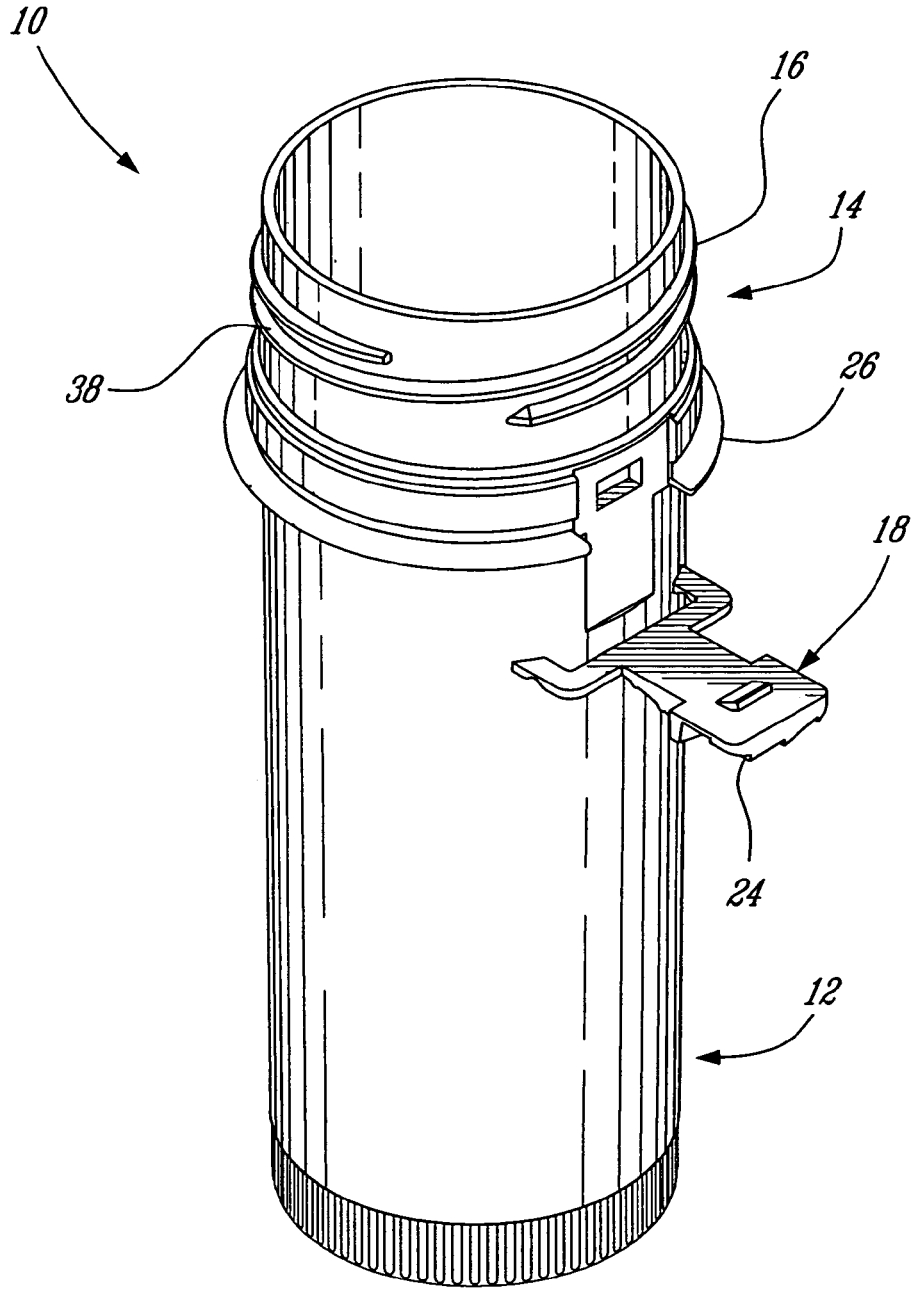
FIG. 1 is a perspective side view of a vial with a security member.
Figure 2:
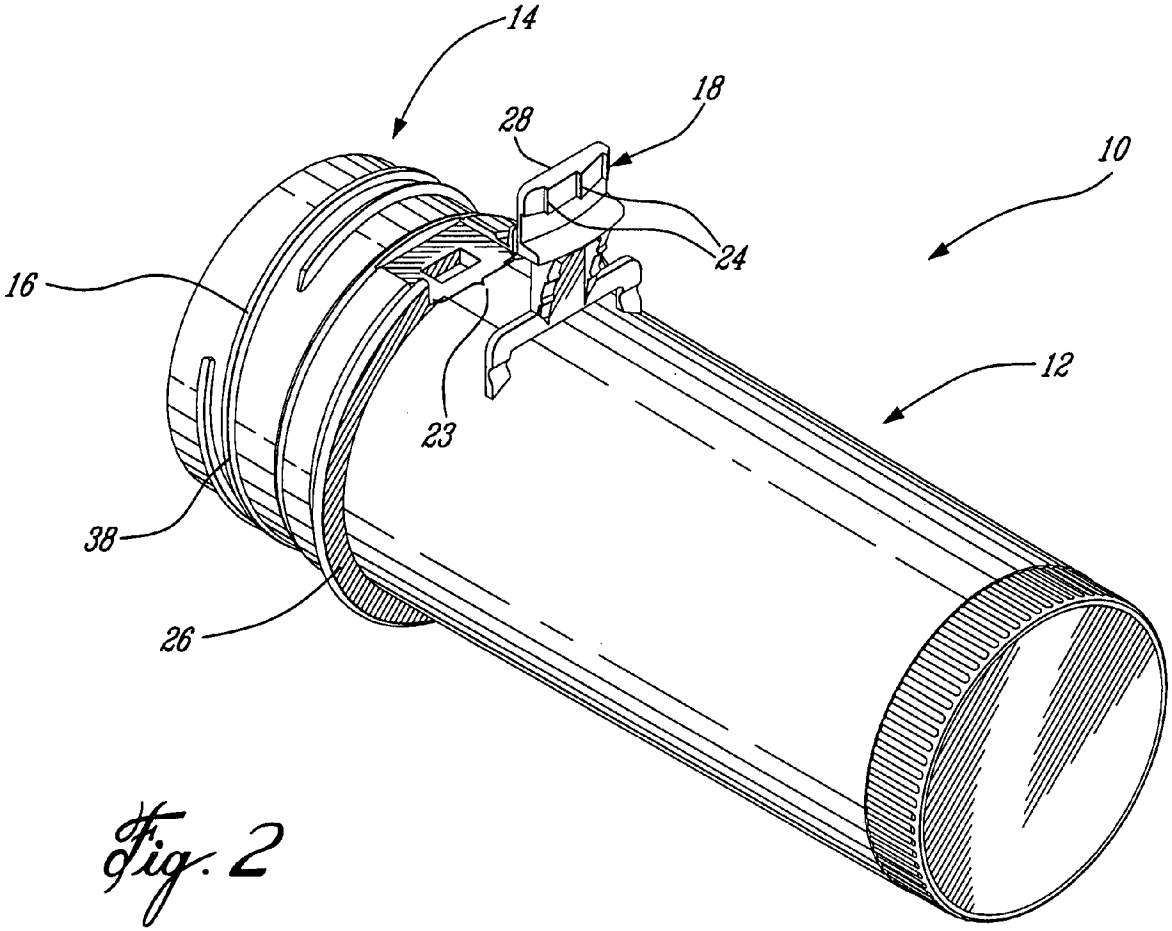
FIG. 2 is a perspective front view of the vial of FIG. 1.

As illustrated in FIGS. 1 and 2 of the appended drawings, a vial 10 typically comprises a lower portion 12 and an upper portion 14.

The lower portion 12 receives a content to be contained, such as a liquid or a solid for example. The upper part 14 is intended to receive a closure element as illustrated in FIG. 3.

Figure 3:
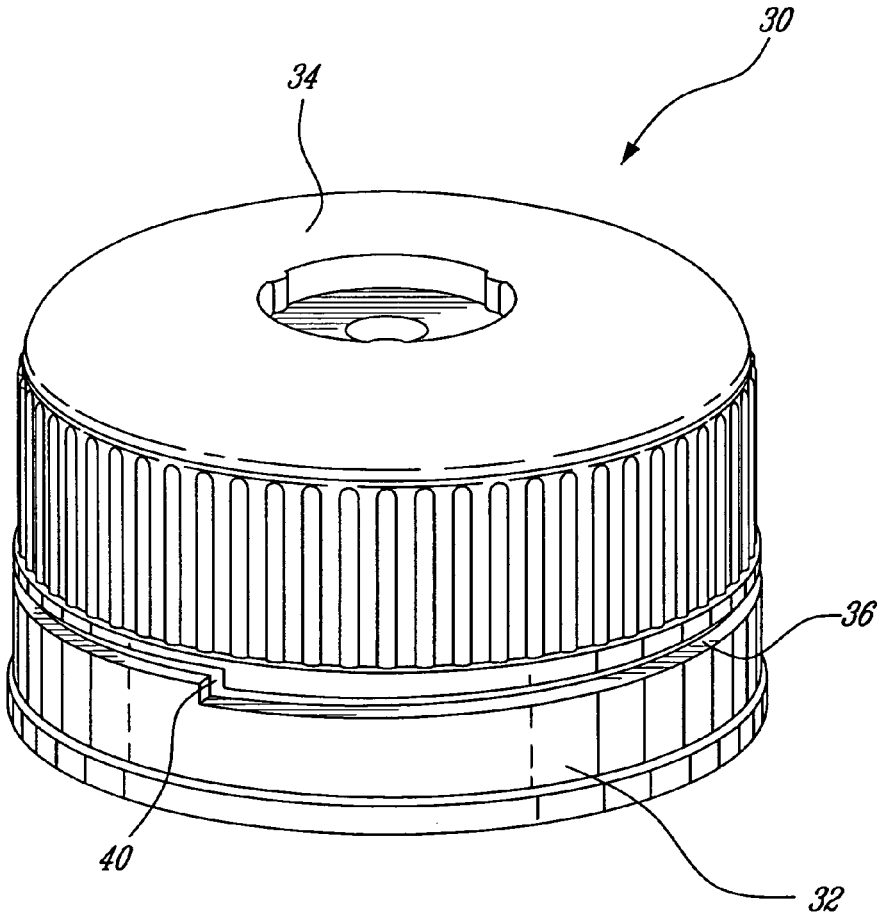
FIG. 3 is a perspective view of a closure cap for the vial of FIG. 1.

The closure element is generally a cap 30 as illustrated in FIG. 3, which is secured onto an outside circumferencial surface of the upper part 14 of the vial.

The cap 30 comprises a ring part 32 connected to a main part 34 by a weakening line or a series of bridges 36. An inner circumferencial surface of the main part 34 is provided with an internal thread (not shown) matching a thread provided on an outside circumferencial surface 38 of the upper part 14 of the vial 10. An inner circumferencial surface (not shown) of the ring part 32 is provided with engaging means, such as indentations or any other members prominent from this circumferencial surface.

The main part 34 of such a closure element may provide a hermetic sealing, while the ring part 32 thereof contributes to a tamper proof feature thereof, as will now be explained.

When the cap 30 is secured on top of the vial 10 by a matching of the internal thread (not shown) of the main part 34 with the thread on the outside circumferencial surface 38 of the upper part 14, the ring part 32 of the cap 30 lies in a region below the thread of the outside circumferencial surface 38 of the upper part 14.

A security member 18 is provided with engaging means 24 complementarily corresponding to the engaging means provided on the inner circumferencial surface (not shown) of the ring part 32 of the cap.

The security member 18 may be positioned in a neutral mode as illustrated in FIGS. 1 and 2 for example, in which it does not take part in the positioning of the cap 30 on top of the vial 10 as previously described. In such a mode, the vial closed with the cap secured on the upper part thereof is opened by unscrewing the cap in a usual way.

Alternatively, the security member 18 may be positioned in an active mode wherein the engaging means 24 come into an engaging contact with the engaging means on the inner circumferential surface of the ring part 32 of the cap as the cap 30 is secured to the vial 10. In this case, any attempt to unscrew the cap 30 will result in the engaging means 24 of the security member 18 to engage the engaging means of the ring part 32, thereby creating a force on the ring part 32, which causes the weakening line 36 to break, and consequently the ring part 32 to separate from the main part 34 of the cap. Such a broken cap is a clear evidence that the vial has been opened.

Therefore, when the vial 10 needs not be closed in a tamper-proof manner, the security member 18 is positioned in the neutral mode thereof.

In the contrary, when the vial 10 needs to be closed in a tamper-proof manner the security member 18 is inserted into the active mode with the engaging means 24 thereof engaging the engaging means (not shown) on the inner circumferential surface of the ring part 32, whereby the cap 30 may only be removed with the ring part 32 thereof being separated from the main part 34 of the cap 30. Indeed, when unscrewing the cap from the upper part 32 of the vial in this mode, the engaging means 24 of the security member engage with the engaging means of the ring part 32, which causes the bridges between the ring part 32 and the main part 34 of the cap 30 to break.

In the embodiment illustrated in FIG. 1 or 2, the security member 18 is pivotally secured on the lower part 12 of the vial 10 so that it may be pivoted form the neutral mode to the active mode, wherein the engaging means 24 thereof come into engagement with the engaging means on the inner circumferencial surface of the ring part 32.

Obviously, the security member may alternatively be secured to the upper part 12 of the vial 10, for example by using an attachment loop (not shown). It may also be attached to the cap 30, provided it may easily be inserted in the desired mode thereof. Alternatively, it may be provided as an independent piece altogether.

Additionally, the main part of the cap and the ring part thereof may be connected along a weakening line provided with at least one ratchet 40 (see FIG. 3) to further increase the force exerted on the weakening line when unscrewing the cap while the security member is in the active mode.

Although the present invention has been described hereinabove by way of embodiments thereof, it can be modified, without departing from the nature and teachings thereof as defined in the appended claims.

What is claimed is:

1. A tamper-proof vial and cap assembly comprising:

a vial having an upper portion;

a cap comprising a main part and a ring part connected to said main part by a weakening line, said cap being able to be secured on said upper portion of the vial, said ring part displaying first engaging means; and a security member insertable between said vial and said cap and displaying second engaging means complementary to said first engaging means of said ring part of the cap;

wherein, when said second engaging means of said security member are engaged with said first engaging means of the ring part, the cap may be removed from the vial with the ring part thereof being separated from the main part thereof along the weakening line; and wherein, when said second engaging means of said security member are disengaged from said first engaging means of the ring part, the cap may be removed from the vial with the ring part thereof remaining connected to said main part thereof.

2. The tamper-proof vial and cap assembly according to claim 1, wherein said security member is attached to the vial.

3. The tamper-proof vial and cap assembly according to claim 1, wherein said security member is attached to the cap.

4. The tamper-proof vial and cap assembly according to claim 1, wherein said first engaging means consist of first indentations and said second engaging means consist of second indentations complementary with said first indentations.

5. The tamper-proof vial and cap assembly according to claim 1, wherein said weakening line includes at least one ratchet.

* * * * *